United States Patent [19]

Kobayashi

[11] Patent Number: 4,755,846

[45] Date of Patent: Jul. 5, 1988

[54] LIGHT TRANSMITTING PLATE HOLDING CONSTRUCTION OF IMAGE FORMING DEVICE

[75] Inventor: Kazuhiro Kobayashi, Osaka, Japan

[73] Assignee: Mita Industrial Co., Ltd, Osaka, Japan

[21] Appl. No.: 19,351

[22] Filed: Feb. 26, 1987

[30] Foreign Application Priority Data

Feb. 28, 1986 [JP] Japan ..... 61-29824[U]

[51] Int. Cl.[4] ..... G03G 15/00

[52] U.S. Cl. ..... 355/3 R; 350/318

[58] Field of Search ..... 355/1, 3 R, 8; 350/318, 350/319

[56] References Cited

U.S. PATENT DOCUMENTS

| | | | |
|---|---|---|---|
| 3,283,651 | 11/1966 | King et al. | 355/1 |
| 4,469,430 | 9/1984 | Terashima | 355/3 R |
| 4,536,057 | 8/1985 | Sumi et al. | 350/318 |
| 4,549,803 | 10/1985 | Ohno et al. | 355/14 FU |

FOREIGN PATENT DOCUMENTS

| | | | |
|---|---|---|---|
| 54-116945 | 9/1979 | Japan | 355/1 |

*Primary Examiner*—A. T. Grimley

*Assistant Examiner*—Jane K. Lau

*Attorney, Agent, or Firm*—Stiefel, Gross & Kurland

[57] ABSTRACT

A light transmitting plate holding construction of an image forming device comprises an elongated optical filter plate, a holder for holding the optical filter plate and a holder mounting means for mounting the holder on a body of an image forming device, wherein the holder is composed of a pair of holder portions clamping the optical filter plate therebetween in opposition, and each of the holder portions includes an internally faced U-shaped portion engaging both long sides of the optical filter plate, and an externally face U-shaped portion extending integrally from one opposed edge of the internally face U-shaped portion.

The holder mounting means includes an opening formed on a frame of the image forming device body and a pair of mounting rails, which are opposing at a prescribed distance so as to guide the optical filter plate and its holder inserted through the opening, enagageable slidably with the pair of externally faced U-shaped portions of the holder, and arranging the optical filter plate at a prescribed position of an optical system path which projects and image information on a photosensitive body.

13 Claims, 5 Drawing Sheets

LIGHT TRANSMITTING PLATE HOLDING CONSTRUCTION OF IMAGE FORMING DEVICE

BACKGROUND OF THE INVENTION

1. Field of the Invention

The present invention relates to a light transmitting plate holding construction of an image forming device. More specifically, it relates to a holding construction of an optical filter or a dust-proof glass plate of an optical system projecting an image information on a photosensitive body.

2. Description of the Prior Art

An image forming device, for example, an electrophotographic copying machine usually utilizes fine particle toner as a developing agent. The toner is so fine and light (e.g. a particle diameter is 5–30 μm and its apparent density is 0.3–0.4 g/cc) that it tends to float inside the copying machine and adhere to each part.

Meanwhile, a light transmitting plate such as an optical filter or dust-proof glass plate may be used in an optical system projecting an image information on a photosensitive body of the image forming device, (e.g. refer to U.S. Pat. No. 4,549,803). Such a light transmitting plate is always exposed to adhesion of the toner, which is an obstacle to the projection of the image information, results in difficulty in accurate copying.

As a countermeasure thereto, it has been proposed to attach means for protecting against adhesion of the toner on the light transmitting plate (see U.S. Pat. No. 4,469,430). That is, a lens as the light transmitting plate is mounted by fixing a clamp member on a lens holder by means of screws, and the clamp member is provided with a dust-proof box removable in a sliding fashion so as to cover only one side of the lens. The dust-proof box is able to remove the toner before it adheres to the lens by the magnetic attraction force of the magnet, thereby reducing adhesion of the toner to the lens. However, since the dust-proof box covers only one side of the lens, it is difficult to totally seal between each part (e.g. between the lens holder and clamp member or the clamp member and dust-proof box) against the fine dust because such parts are very elongated. Thus, in particular, when a great number of copies are made rapidly and continuously as recently, the lens must be cleaned at constant intervals. However, to clean the lens, it must be taken out by sliding the dust-proof box off from the clamp member, which is further removed by loosening screws. In short, when dust adhered to the lens has to be cleaned, a complicated and skilled operation is necessitated. Thus, only a special technician familiar with the internal construction of the image forming device is allowed perform such an operation.

SUMMARY OF THE INVENTION

The present invention provides a light transmitting plate holding construction of an image forming device comprising an elongated light transmitting plate, a holder for holding the light transmitting plate, and a holder mounting means for mounting the holder on the image forming device body, wherein the holder comprises a pair of holder portions clamping the light transmitting plate in opposition, and each of the holder portions provides an internally faced U-shaped portion engaged both long sides of the light transmitting plate and an externally faced U-shaped portion extending integrally from one opposite edge of the internally faced U-shaped portion, and the holder mounting means comprises an opening formed on a frame of the image forming device body and a pair of mounting rails, which are opposing each other at a prescribed distance so as to guide the light transmitting plate and its holder inserted through the opening, engageable slidably with the pair of externally faced U-shaped portions of the holder, and arranging the light transmitting plate at a prescribed position on an optical system path projecting an image information on the surface of a photosensitive body.

That is, the present invention is devised to place and remove the light transmitting plate for cleaning and replacing thereof with a simple construction and operation, by holding the light transmitting plate with a specific holder and providing the mounting rail so as to be able to insert and hold the holder through the opening provided on the frame of the image forming device body.

DESCRIPTION OF THE PREFERRED EMBODIMENTS

Figure 1:
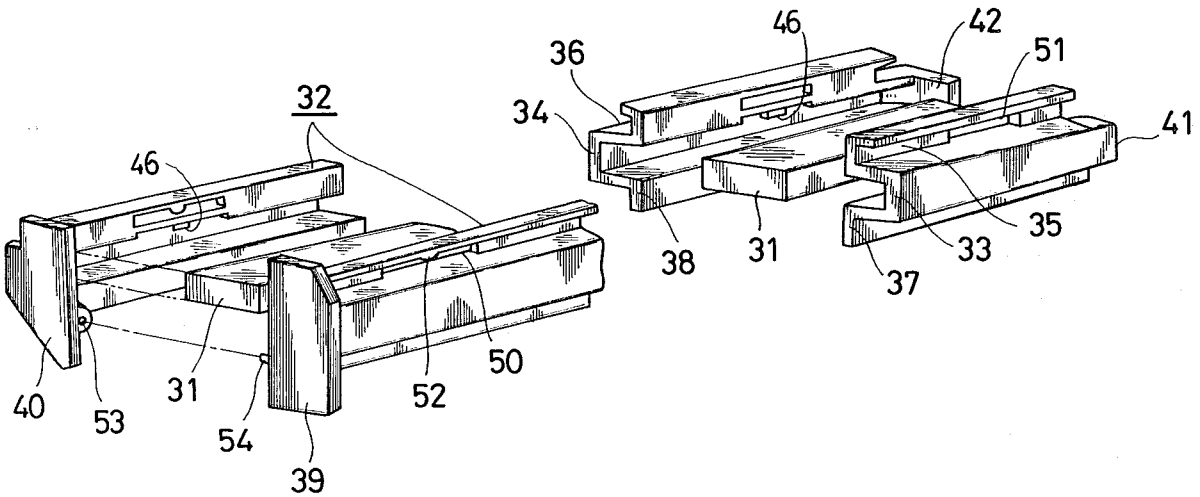
FIG. 1 is an exploded perspective view showing an essential portion of one embodiment in accordance with the present invention.

In the present invention, a holder is composed of a pair of holder portions clamping a light transmitting plate in opposition. In each holder portion, a specific protruding tab and slit are desirably formed so as to enable retention of the holder sufficiently elastically, so that the light transmitting plate can be mounted removably on the holder without damaging the surface thereof.

That is, it is preferred to construct an externally faced U-shaped portion of each holder portion to extend in an L-shape integrally from one edge of an opposed piece of an internally faced U-shaped portion, to form an externally faced U-shaped with the L-shape portion and one opposed piece of the internally faced U-shaped portion from which the L-shape portion is extended, and to form two or more protruding tabs pressing the light transmitting plate on one inner surface of said opposed piece. Also, slits corresponding to each protruding tab are preferably formed to tolerate deformation occurring in the vicinity of the protruding tabs when the light transmitting plate is pressed with each protruding tab, on the bottom piece of said L-shaped portion.

Now, a specific example of dimensions of the protruding tabs and slits when each holder portion is formed of synthetic resins such as polyamide resins (e.g. Nylon), ABS resins, styrene resins, acrylic resins is as follows; that is, the height of each protruding tab is preferably 0.7–1.0 mm, the length in press-in direction of the light transmitting plate is 1–3 mm, the width 4–5 mm, and each slit is preferably 18–30 mm longitudinally centered at the corresponding protruding tab.

In the present invention, at least one of the longitudinal mid-bottom portions of the internally faced U-shaped portion is preferably formed substantially shallower than that of both side portions.

The expression "substantially shallower" means that the longitudinal mid-bottom portion is formed to contact at least the mid portion of the light transmitting plate, which is, thereby, assured of being set at a prescribed position on the optical system path even if dimensions of each portion of the individual holder are more or less dispersed.

Thus, the shallow mid portion has only to be formed in a sufficient width to contact the light transmitting plate, that is, the length of depths of U-shaped portions formed by the two holders has to be formed to coincide with the width of the light transmitting plate. More specifically, from this point, the longitudinal mid-bottom portion of the internally faced U-shaped portion is formed shallower by 0.5–2 mm than that of both side portions to meet the aforementioned requirement.

In the present invention, the two holder portions may be formed integrally by adhesion or fusion weld so as to be disposable, or formed in parts so as to enable the replacement of the light transmitting plate.

One embodiment of the present invention illustrated in the drawings is now explained in details as follows. It is to be understood, however, that the present invention is not limited thereto.

Figure 5:
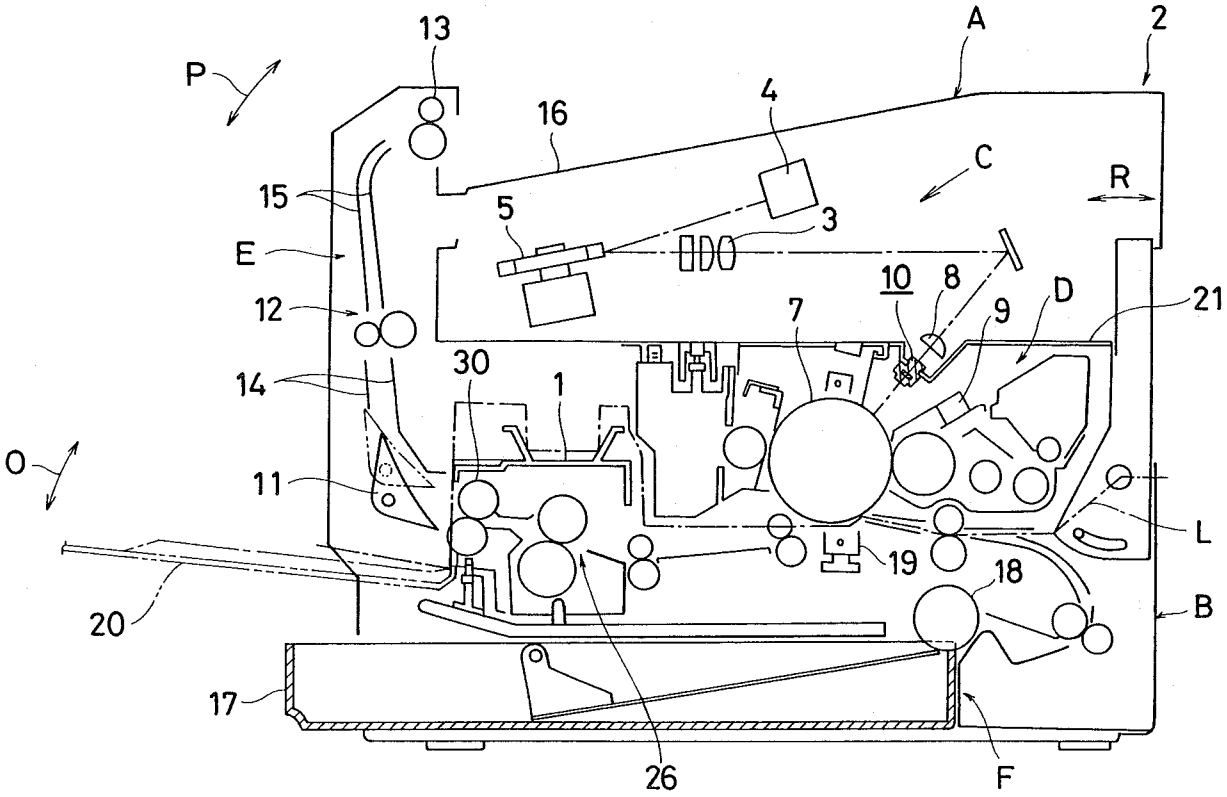
FIG. 5 is a structural explanatory view of essential portions of an electrophotographic copying machine.

First in FIG. 5, an electrophotographic copying machine (1) as an image forming device mainly comprises a main body (2), a photosensitive drum (7) disposed on the body, an optical system (C) which projects an image information on the surface of the photosensitive drum, a developing unit (D), a transfer unit (19), a fixing unit (26), a paper feed unit (E) and the like.

Figure 4:
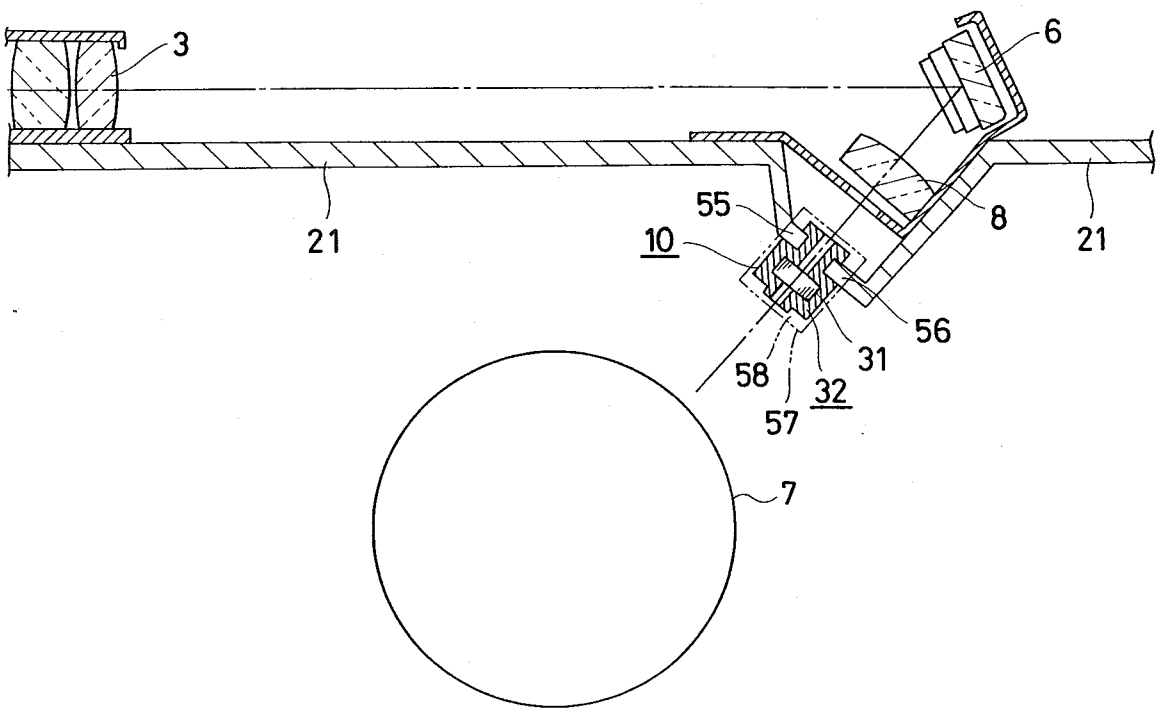
FIG. 4 is a structural sectional explanatory view of an essential portion.

The optical system (C) includes a laser light source (4), a polygon mirror (5), a mirror (6) and various lens systems (3) (8) as well as an optical filter (10), which in FIG. 4, comprises an elongated optical filter plate (31) and a holder (32) holding the filter plate, which are all mounted and held on a horizontal intermediate plate (21) of the main body (2). Here the horizontal intermediate plate (21) divides the optical system (or the optical system portion, C) and the image forming portions such as the photosensitive drum (7), developing unit (D) and transfer unit (19).

Figure 2:
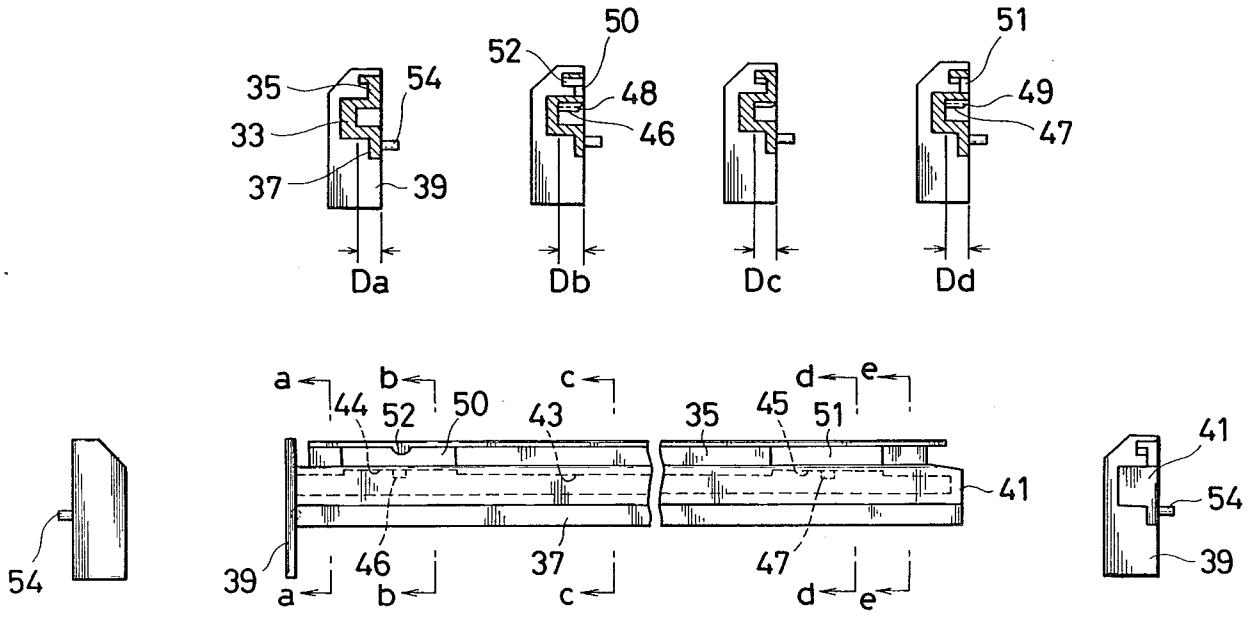
FIGS. 2 and 3 are structural explanatory views of its holder.
Figure 3:
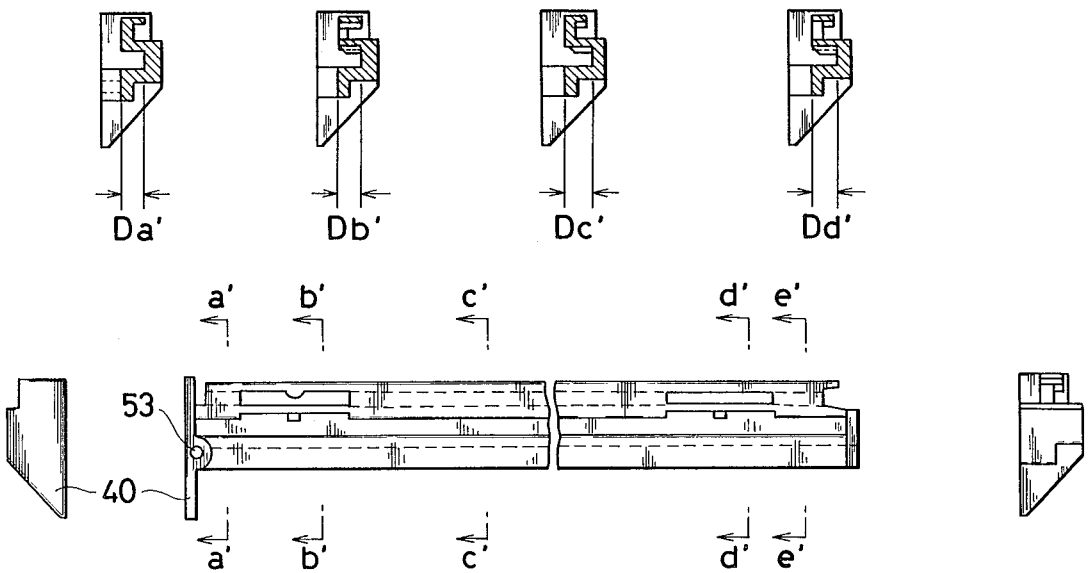

The holder (32) in FIGS. 1 through 3, mainly comprises a pair of internally faced U-shaped portions (33) (34) engaging the two long sides of the optical filter plate (31), externally faced U-shaped portions (35)(36) extending in a L-shaped integrally from one opposed edge of the internally faced U-shaped portion to form an externally faced U-shape with the end piece of the internally faced U-shaped portion, a pair of flat portions (37)(38) extending integrally in flat from the other opposed edge of the internally faced U-shaped portion, and front end portions (39)(40) and rear end portions (41)(42) integral with each part aforementioned, and composed of two parts of a pair of holder portions which clamp the optical filter plate (31) in opposition, and formed by injection molding of ABS resin (acrylonitrile.butadiene.styrene.copolymer resin).

The internally faced U-shaped portion (33) is formed with shallow concave steps (44)(45) on one inner surface (43), and at the center of the concave steps (44)(45), on the contrary, protruding tabs (46)(47) (height 0.85 mm, length 2.00 mm, width 4–5 mm) are projected from the inner surface. The numerals (48)(49) indicate chamfers. Thus, the optical filter plate (31) is pressed easily into the internally faced U-shaped portion (33) through the chamfers (48)(49) and coupled with the protruding tab (46)(47) in a less detachable fashion.

In this case, the protruding tabs (46)(47) are expanded by the optical filter plate (31), which is made possible by slits (50)(51) to be described later, and further the optical filter plate is held sufficiently elastically so as to be mounted removably on the holder without being damaged on its surface.

The externally faced U-shaped portion (35) is formed with the slits (50)(51) (longitudinal dimension 20.00 mm) on its bottom piece corresponding to the concave steps (44)(45), and a convex rail (52) is formed on the inner surface of one slit (50). Explanation of the internally faced U-shaped portion (34) and the externally faced U-shaped portion (36) will be omitted as their constructions are similar to (33) and (35). The numerals (53) (54) indicate concave-convex portions for coupling the holder formed in two parts.

Meanwhile, on the intermediate plate (21) of the main body (2), a slitlike opening is formed at a prescribed position on the optical system path for projecting the image information on the photosensitive drum, thereby forming mounting rails (55) (56) opposing each other at a prescribed distance. On the extended line of the mounting rails (55)(56) on a front side frame (57), a port (58) for inserting the holder (32) is formed.

Thus, when the holder (32) is inserted through the port (58), the holder (32) is slidably guided at its externally faced U-shaped portions (35)(36) on the mounting rails (55) (56), and the front end portions (39)(40) are contacted with the port (58) so as to be positioned.

The convex rail (52) retains the positional state such that the holder (32) is not easily detached. Next, in FIGS. 2 and 3, the depth of the internally faced U-shaped portions (33)(34) of the holder (32) changes smoothly, specifically, Da−e and Da′−e′ are set as follows:

Da=5.0 mm
Db=5.0 mm
Dc=4.0 mm
Dd=5.0 mm
De=5.0 mm
Da′=5.0 mm
Db′=5.0 mm
Dc′=4.0 mm
Dd′=5.0 mm
De′=5.0 mm

However, the electrophotographic copying machine has a relatively short dimension of maximum width of A-4, the total holder length is 217.5 mm.

Thus, since the internally faced U-shaped portions (33)(34) are formed shallower at the longitudinal mid portions and become deeper gradually as they approach both longitudinal sides, even if dimensions are more or less dispersed, at least the center portion of the optical filter is contacted with the U-shaped portions (33)(34), assuring the set position on the optical system path (route) accurately. The dimensions Da, Da′, De and De′ may be set at about 4.5 mm to prevent the center diversion of the optical filter.

Alternatively to the aforementioned embodiment, a dust-proof glass plate may be used as the light transmitting plate. Also, in some occasions, the optical filter plate the dust-proof glass plate are used inside the optical system, and in such case, the holder in accordance with the present invention may be utilized.

What is claimed is:

1. A light transmitting plate holding construction of an image forming device comprising an elongated light transmitting plate, a holder for holding the light transmitting plate and a holder mounting means for mounting the holder on an image forming device body, wherein the holder comprises a pair of holder portions clamping the light transmitting plate therebetween in opposition, in which each of the holder portions provides an internally faced U-shaped portion engaging both long sides of the light transmitting plate and an externally faced U-shaped portion extending integrally from one opposed edge of the internally faced U-shaped portion, and the holder mounting means comprises an opening formed on a frame of the image forming device body and a pair of mounting rail, which are opposing each other at a prescribed distance so as to guide the light transmitting plate and its holder inserted through the opening, engageable slidably with the pair of externally faced U-shaped portions of the holder, and arranging the light transmitting plate at a prescribed position on a optical system path for projecting an image information on a photosensitive body.

2. A construction according to claim 1 wherein the externally faced U-shaped portion of each holder is extended in a L-shape integrally from one edge of opposed piece of an internally faced U-shaped portion, and formed in an externally faced U-shape with the L-shaped portion and one opposed piece of the internally faced U-shaped portion from which the L-shaped portion is extended, and further said one opposed piece is provided with two or more protruding tabs pressing the light transmitting plate on the inner surface, and said L-shaped portion is provided with slits on its bottom piece corresponding to each protruding tab to tolerate deformation occurred in the vicinity of the protruding tabs when the light transmitting plate is pressed with each protruding tab.

3. A construction according to claim 2 wherein the height of each protruding tab is 0.7–1.0 mm, the length in a press-in direction of the light transmitting plate is 1–3 mm and the width is 4–5 mm, and each slit is 18–30 mm longitudinally centered at each protruding tab.

4. A construction according to claim 2 wherein each holder portion includes each two pairs of protruding tabs and slits.

5. A construction according to claim 2 wherein each protruding tab is provided with a chamfer on the tip to facilitate a smooth insertion of light transmitting plate against internally faced U-shaped portion.

6. A construction according to claim 2 wherein the L-shaped portion is provided with a convex rail on the inner surface for enabling its side piece to hold the holder on the mounting rail so as not to be detachable.

7. A construction according to claim 1 wherein the internally faced U-shaped portion is formed substantially shallower at least at one longitudinal mid bottom portion than both side portions.

8. A construction according to claim 7 wherein the longitudinal mid bottom portion is shallower than both side portions by 0.5–2 mm.

9. A construction according to claim 1 wherein the light transmitting plate is an optical filter plate.

10. A construction according to claim 1 wherein the frame divides an optical system portion and an image forming portion, and includes an intermediate plate having a slit-like opening on the optical system path, the mounting rails are formed by the slitlike opening.

11. A construction according to claim 1 wherein the holder includes a front end portion on each holder portion, which contacts the opening when the holder is inserted therethrough, and sets the holder at a prescribed position on the mounting rail.

12. A construction according to claim 1 wherein the two holder portions are combined by means of adhesion or fusion weld.

13. A construction according to claim 1 wherein the two holder portions are dividable for replacing the light transmitting plate.

* * * * *

UNITED STATES PATENT AND TRADEMARK OFFICE

CERTIFICATE OF CORRECTION

PATENT NO. : 4,755,846

DATED : July 5, 1988

INVENTOR(S) : Kazuhiro Kobayashi

It is certified that error appears in the above-identified patent and that said Letters Patent is hereby corrected as shown below:

Column 6, line 14: Claim 6: "convex rail" should read --protruding tab--.

Signed and Sealed this

Second Day of May, 1989

*Attest:*

DONALD J. QUIGG

*Attesting Officer*

*Commissioner of Patents and Trademarks*